US005542282A

United States Patent [19]

Muldner

[11] Patent Number: 5,542,282

[45] Date of Patent: Aug. 6, 1996

[54] MARKLESS PRESS BRAKE MATERIAL PROTECTOR

[75] Inventor: James S. Muldner, Penn Valley, Calif.

[73] Assignee: Inner Act, Inc., Morgan Hill, Calif.

[21] Appl. No.: 208,974

[22] Filed: Mar. 9, 1994

[51] Int. Cl.[6] ..... B21D 5/02

[52] U.S. Cl. ..... 72/389.3; 72/414

[58] Field of Search ..... 72/389, 414, 57, 72/63, 465

[56] References Cited

U.S. PATENT DOCUMENTS

| | | | |
|---|---|---|---|
| 2,293,184 | 6/1941 | Weissert | 72/389 |
| 3,986,379 | 10/1976 | Mansell | 72/57 |

FOREIGN PATENT DOCUMENTS

| | | | |
|---|---|---|---|
| 0032525 | 2/1983 | Japan | 72/389 |
| 0176426 | 8/1986 | Japan | 72/465 |
| 0011225 | 1/1990 | Japan | 72/57 |
| 0683835 | 9/1979 | U.S.S.R. | 72/465 |
| 2208619 | 4/1989 | United Kingdom | 72/57 |

*Primary Examiner*—David Jones

*Attorney, Agent, or Firm*—James J. Leary; Carol A. Duffield

[57] ABSTRACT

A system for preventing scratches, dents and die marks on sheet metal parts during bending and forming operations. The system holds a supply of protective material, such as plastic film, canvas or sailcloth, on a roll or other convenient form and applies the protective material across the die and/or the punch of a press brake or other sheet metal bending or forming equipment. The system is configurable to cover a die or punch of practically any size from a few inches to several feet. The system is programmable to advance the protective material a preset amount after a given number of cycles of the equipment. Different configurations of the system are described which advance the protective material longitudinally along the punch or die or transversely across the punch or die of the press brake.

20 Claims, 8 Drawing Sheets

MARKLESS PRESS BRAKE MATERIAL PROTECTOR

FIELD OF THE INVENTION

The present invention relates to a system for reducing scratching, marring or other marks produced on sheet metal during the sheet metal bending process. More specifically, it relates to a system which automatically feeds a web of protective material between the sheet metal and the die or the punch of a press brake to protect the surface of the sheet metal during the bending operation.

BACKGROUND OF THE INVENTION

Many sheet metal parts are produced by bending the sheet metal with a press brake or similar sheet metal bending machine. Press brakes are also sometimes known in the industry as bending brakes, bending presses or pan brakes. Typically a press brake is a hydraulic press which has a metal die and a metal punch which are shaped to form a particular bend or curve in the sheet metal when the die and punch are pressed together with the sheet metal in-between. Because it involves metal-to-metal contact and because there is often relative movement between the sheet metal and the punch or die, it is not uncommon for there to be die marks or scratches in the surface of the sheet metal from the bending process. For high precision sheet metal parts or for parts that must be visually perfect such as metal cabinets or display cases, it is highly undesirable to have scratches and marks on the parts. Precoated, plated or painted sheet metal is especially susceptible to scratching or marring during the bending process. Also, scratches in the surface can cause problems in the painting or plating process if the parts are painted or plated after bending.

Some sheet metal shops have recognized this problem and have begun using sheets of protective material such as plastic film, canvas or sailcloth between the sheet metal and the punch or die to avoid causing marks. The sheets of protective material must be individually cut and is manually placed on the press brake. This process is tedious and time consuming and it slows down the production of parts. It is also not entirely reliable because the loose sheets of protective material are free to move until the press closes. Consequently, the protective material sometimes shifts, exposing the sheet metal to being scratched or indented by the machine. Because the manual process of cutting and placing the protective material is so time consuming, machine operators may try to use the same sheet of material over and over again without moving or replacing it. If this is done the protective material quickly wears through at the high pressure points, exposing the sheet metal parts to possible damage. It would, therefore, be desirable to provide a system for quickly, reliably and automatically applying protective material to a press brake to prevent scratching and marking of sheet metal during bending operations.

SUMMARY OF THE INVENTION

In keeping with the foregoing discussion, it is an objective of the present invention to provide a system for preventing scratches, dents and die marks on sheet metal parts during bending and forming operations by applying a web of protective material between the sheet metal part and the bending or forming tooling. It is an important aspect of this objective that the system should conveniently, repeatably and automatically perform its function so that reliable protection is provided to each workpiece without slowing down or otherwise interfering with the production of parts. Another objective is that the system should be capable of advancing the protective material in preset increments at appropriate intervals to insure an intact protective sheet between the tool the sheet metal parts. It is another objective to provide a system that is compatible with existing press brakes and other sheet metal forming equipment. An important aspect of this objective is that the system should fasten to the equipment without undue modification of the equipment and it should not interfere with the function of the equipment or the loading and unloading of sheet metal parts. Another aspect of this objective is that the system should be able to be used with different sizes of equipment or different sizes of tooling and should use the protective material efficiently and economically so as not to add unduly to production costs.

In accordance with these objectives, the present invention takes the form of a system which holds a supply of protective material, such as plastic film, canvas or sailcloth, on a roll or other convenient form and applies the protective material across the die and/or the punch of a press brake or other sheet metal bending or forming equipment. The system is configurable to cover a die or punch of practically any size from a few inches to several feet. The system is programmable to advance the protective material a preset amount after a given number of cycles of the equipment. Different configurations of the system are described which advance the protective material longitudinally along the punch or die or transversely across the punch or die. Other objects and advantages of the invention will no doubt occur to those skilled in the art upon reading and understanding the following detailed description along with the accompanying drawings.

DETAILED DESCRIPTION OF THE INVENTION

Figure 1D:
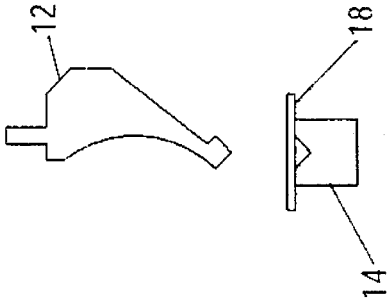
FIG. 1 A–D shows a diagram of a bending operation performed with a press brake equipped with a markless system for applying protective material to the bending die.
Figure 1C:
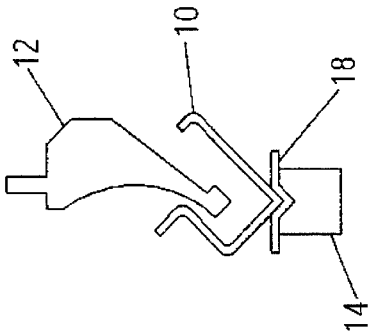
Figure 1B:
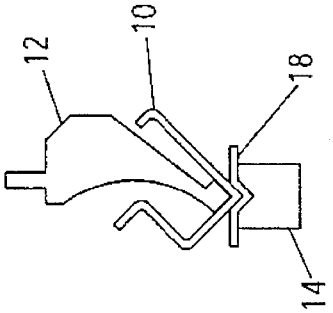
Figure 1A:
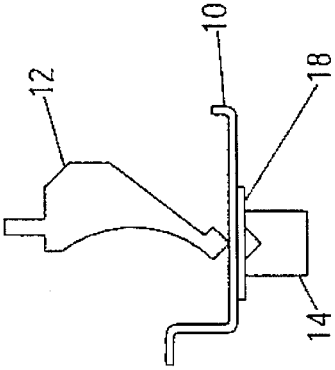
Figure 2D:
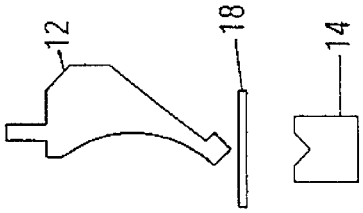
FIG. 2 A–D shows a diagram of a bending operation performed with a press brake equipped with a markless system for applying protective material to the bending punch.
Figure 2C:
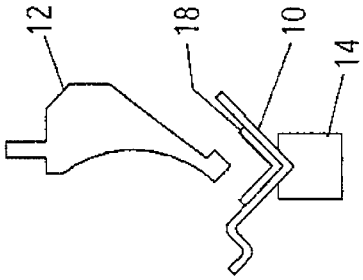
Figure 2B:
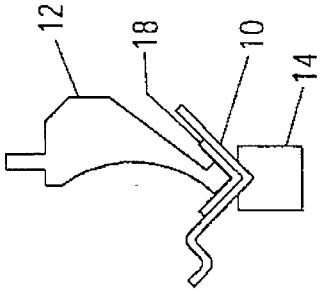
Figure 2A:
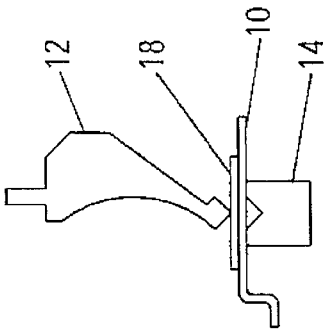

FIG. 1 A–D shows a diagram of a typical sheet metal bending operation. The sheet metal 10 is placed between the punch 12 and the die 14 of the press brake 16 (seen in FIGS.

3–5). In prior art press brakes, the punch 12 and the die 14 would bear directly on the sheet metal 10 with the potential that they would cause die marks or scratches on the surface of the sheet metal part 10. With the present invention, a web of protective material 18 is interposed between the "finished" side of the sheet metal and the bending tool. In this case, the protective material 18 is placed across the die 14 of the press brake 16 to protect the lower surface of the sheet metal part 10.

In FIG. 1 A the sheet metal part 10 has been placed between the punch 12 and the die 14. The protective material 18 covers the die 14. FIG. 1 B shows the punch 12 descending to bend the sheet metal 10 to the desired shape. The protective material 18 conforms to the sheet metal 10 as it is pressed into the die 14 by the punch 12, thereby protecting the lower surface of the sheet metal from scratching or marring. After the sheet metal 10 has been bent to the proper shape, the punch 12 withdraws, as shown in FIG. 1 C, so that the sheet metal part 10 can be removed from the die 14. In FIG. 1 D, the punch 12 and the die 14 are open to receive another sheet metal part 10 and the protective material 18 has advanced so that there is a new section of the protective material 18 positioned across the die 14.

Protective materials 18 which have been found to be useful with the present invention include canvas, sailcloth, paper and plastic film, such as polyethylene, polypropylene, nylon, polyurethane and p.v.c. films. Other woven or non-woven materials such as Tyvek® or Kevlar® can also be used as protective material webs. This is not meant to be an exhaustive list. Many other materials may be found that are equally usable with the different embodiments of the system described below.

In FIG. 2 A–D, the system has been configured so that the protective material 18 is positioned across the punch 12 of the press brake 16 to protect the upper surface of the sheet metal part 10. In FIG. 2 A the sheet metal part 10 has been placed between the punch 12 and the die 14. The protective material 18 covers the punch 12. FIG. 2 B shows the is punch 12 descending to bend the sheet metal 10 to the desired shape. The protective material 18 conforms to the sheet metal 10 as the punch 12 presses it into the die 14, thereby protecting the upper surface of the sheet metal from scratching or marring. After the sheet metal 10 has been bent to the proper shape, the punch 12 withdraws, as shown in FIG. 2 C, so that the sheet metal part 10 can be removed from the die 14. In FIG. 2 D, the punch 12 and the die 14 are open to receive another sheet metal part 10 and the protective material 18 has advanced so that there is a new section of the protective material 18 positioned across the punch 12.

Figure 3:
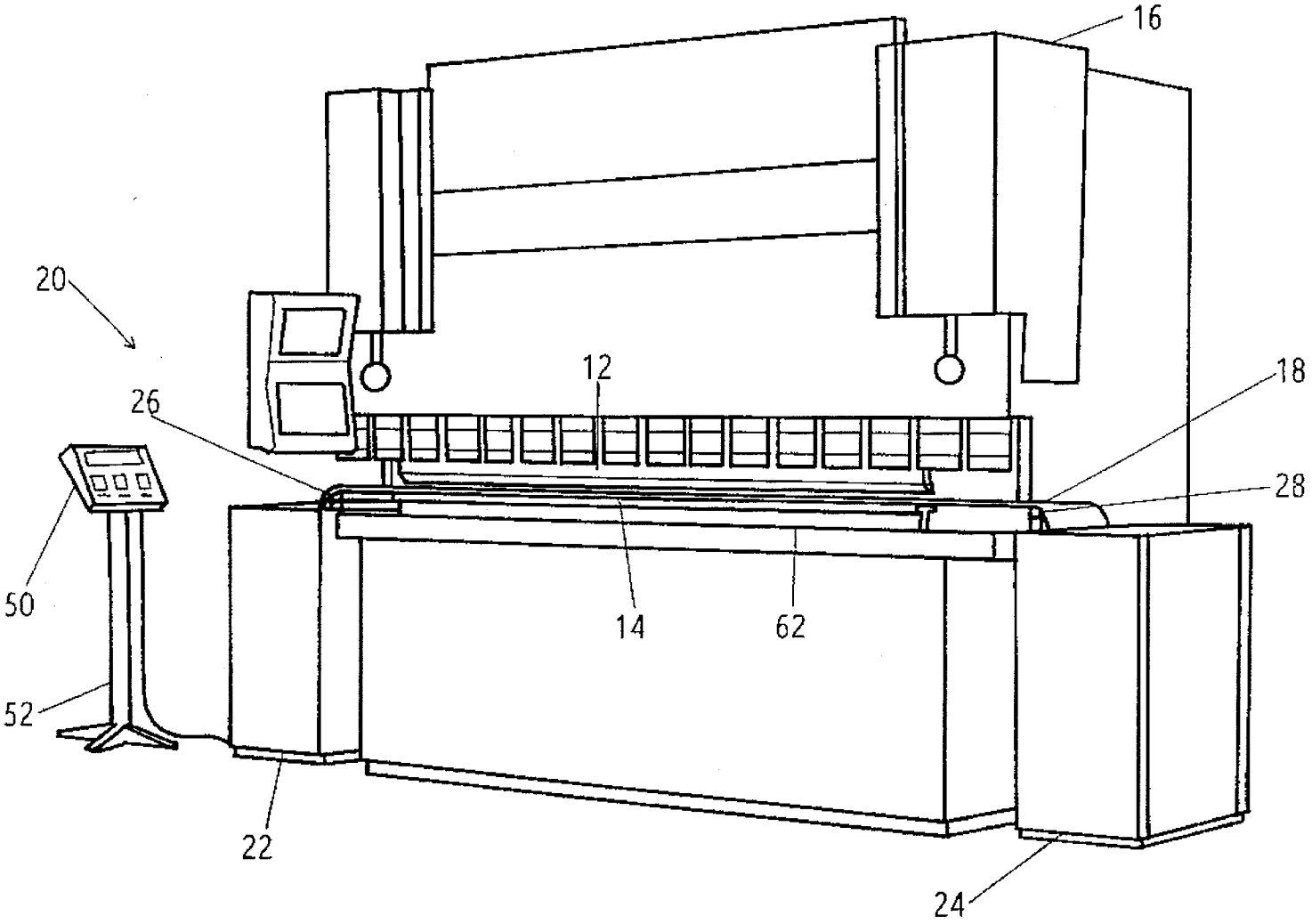
FIG. 3 shows a first embodiment of the markless system for applying protective material to the bending die mounted on a press brake.

The principles of operation described in FIGS. 1 and 2 can be embodied in a number of different configurations for use with a press brake or other sheet metal forming equipment. FIG. 3 shows a first embodiment of the markless system 20 configured to cover the die 14 of a press brake 16 with a web of protective material 18. The system 20 has a first enclosure 22 which houses a supply of protective material 18 on a feed roll. The protective material web 18 exits the top of the first enclosure 22 and passes over a first guide roller 26 which is set at the height of the die 14 of the press brake 16. The protective material 18 passes over the die 14, across a second guide roller 28 and into a second enclosure 24 where it is wound onto the take up roll.

Figure 4:
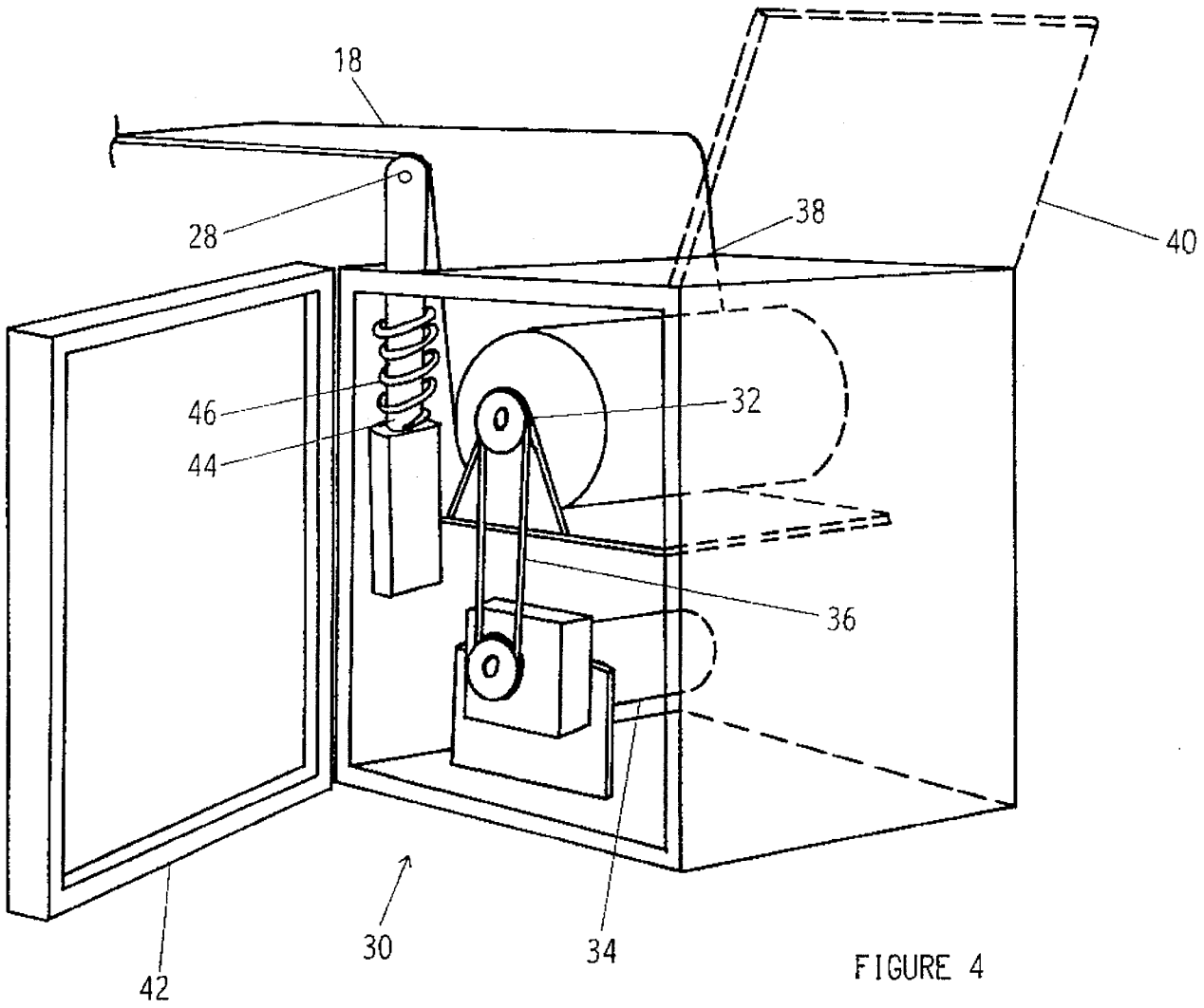
FIG. 4 shows a detail drawing of the drive mechanism of the markless system.

FIG. 4 shows a detail drawing of the interior of the second enclosure 24. The following description of the drive mechanism 30 in the second enclosure 24 is equally applicable to the first enclosure 22, as well. A roll of protective material 18 is held on the feed/take up reel 32 inside the enclosure 24. The feed/take up reel 32 is driven by a motor drive mechanism 34 by way of a drive belt 36 or other transmission means. The protective material 18 exits the enclosure 24 through a slot 38 in the top of the enclosure 24. The protective material 18 passes over the guide roller 28 which has a height adjustment 44 for aligning the protective material 18 with the top of the die 14. A spring tensioner 46 or other tensioning mechanism keeps the protective material 18 taut across the top of the die 14. Optionally, the spring tensioner 46 can be made to release the tension on the protective material 18 during the downstroke of the press brake punch 12. This option may be desirable if the system is to be used with nonelastic protective materials such as canvas or sailcloth. A front door 42 and a top door 40 can be opened for easy access to the interior of the enclosure 24 for adjustments and for changing the roll of protective material 18.

Preferably, the first enclosure 22 contains another drive mechanism 30 which is the mirror image of the drive mechanism 30 just described so that the protective material 18 can be advanced in either direction. For cost savings, it may at times be desirable to replace one of the drive mechanisms 30 with a simpler tensioning device such as a torsional spring or friction rollers. This will save manufacturing costs at the expense of being able to drive the protective material 18 in either direction.

Returning to FIG. 3, the drive mechanisms 30 inside the enclosures 22, 24 are controlled by the control module 50. The control module 50 automatically or manually controls the advancement of the protective material 18 in feet or inches across the die 14. The protective material 18 can be programmed to advance with each stroke of the press brake 16 or the program can be set to allow the protective material 18 to dwell in one position for several strokes of the press brake 16 before advancing. The interval and the distance that the protective material 18 is advanced will be determined by the operator depending on the width of the punch 12 and die 14, the force applied by the punch 12 and die 14, the abrasiveness of the sheet metal and the type of protective material 18 used. Ideally, the advancement of the protective material 18 should be set to provide reliable protection to the sheet metal parts without undue waste of the protective material 18. The control module 50 may be mounted on a stand 52 or made removable for operator convenience. Other system parameters, such as material tension, height and front to rear adjustment and alignment could also be controlled from the control module 50 if these functions are automated.

Figure 5:
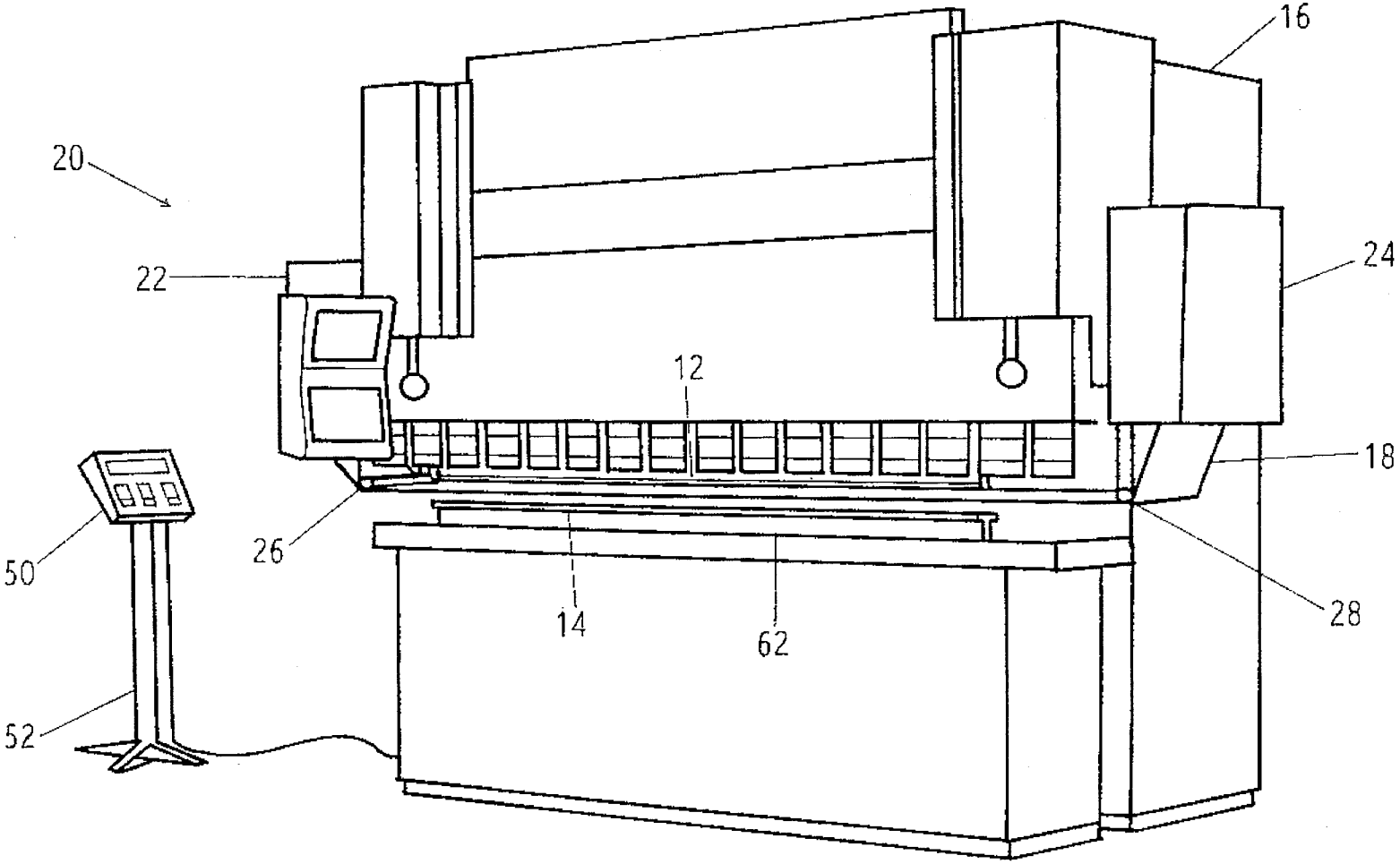
FIG. 5 shows a second embodiment of the markless system for applying protective material to the bending punch mounted on a press brake.

FIG. 5 shows a second embodiment of the markless system 20 configured to cover the punch 12 of a press brake 16 with the web of protective material 18. Whether or not the protective material 18 should cover the punch 12 or the die 14 of the press brake 16 or both depends on which side of the sheet metal will end up on the "finished" side of the part. In this embodiment the system 20 is essentially inverted so that the first and second enclosures 22, 24 are mounted above the punch 12 and the die 14 of the press brake 16 and the protective material 18 is tensioned across the punch 12. The other details of this configuration are essentially the same as described for the embodiment in FIG. 3.

Figure 6:
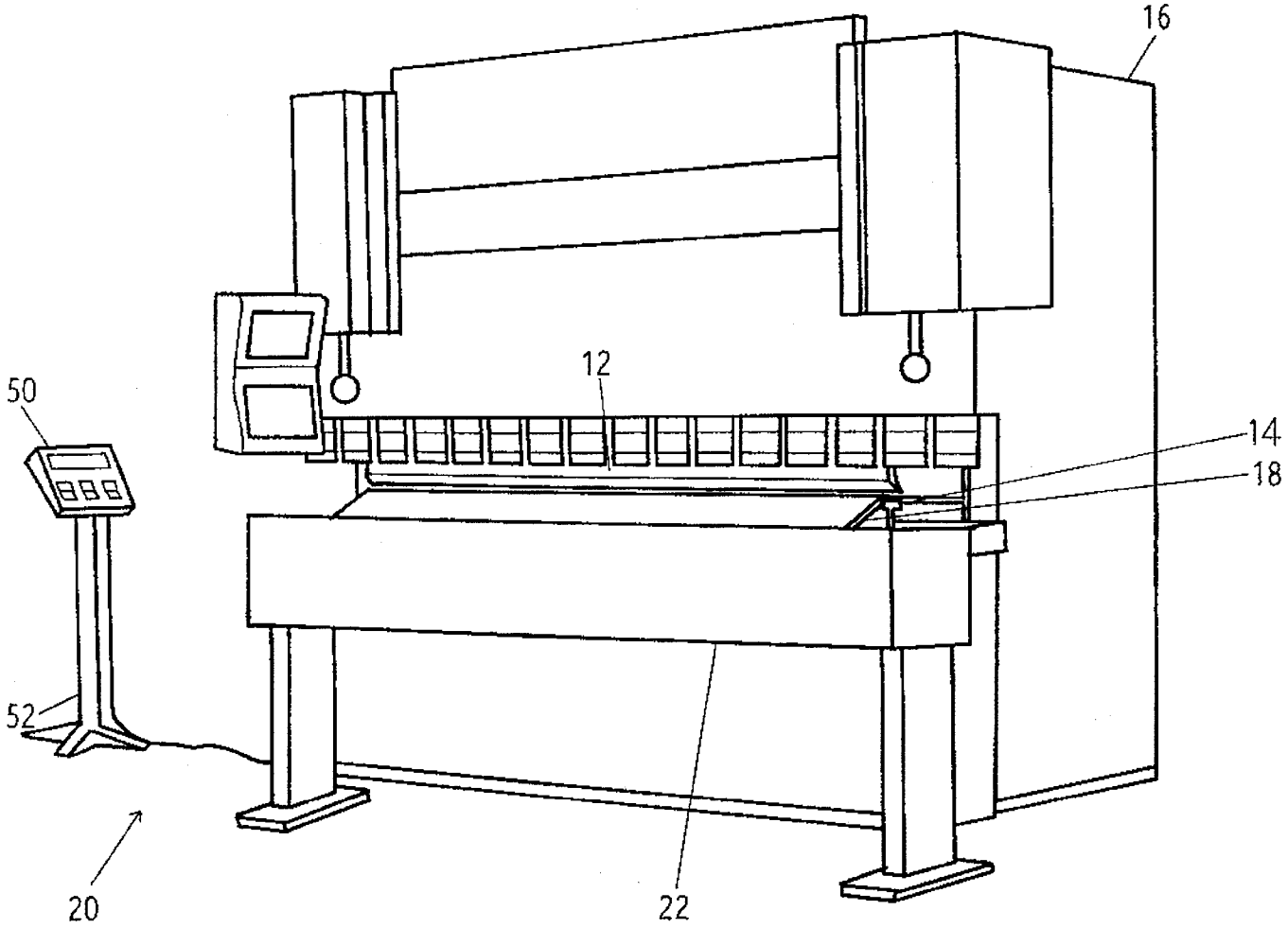
FIG. 6 shows a third embodiment of the markless system for applying protective material to the bending die mounted on a press brake.

The markless system 20 can also be configured so that the protective material 18 moves transversely to the punch 12 and die 14 of the press brake 16, as in the third embodiment shown in FIG. 6. In this embodiment, the first enclosure 22 is mounted in front of the press brake 16 and the second enclosure 24 (not visible in this view) is mounted behind the press brake 16. The wide sheet of protective material 18 crosses the die 14 and passes all the way through the space in the center of the press brake 16. This configuration of the invention would be most useful when long production runs of very large sheet metal parts are to be made on the press brake. This configuration would not be preferred when only small parts are to be made because it would be wasteful of the protective material 18.

Figure 7C:
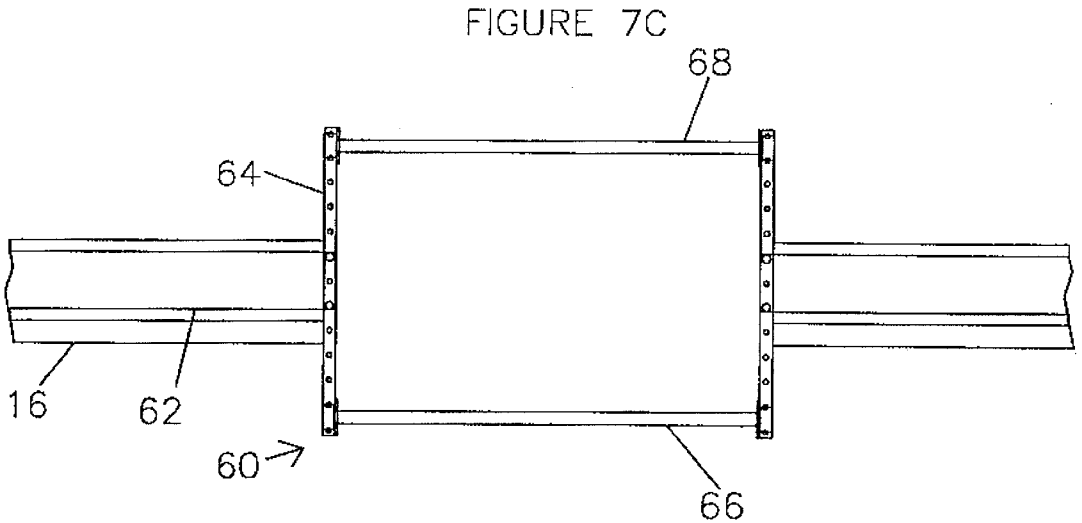
FIGS. 7 A–C show a forth embodiment of the markless system which mounts on the tool holder of the press brake.
Figure 7B:
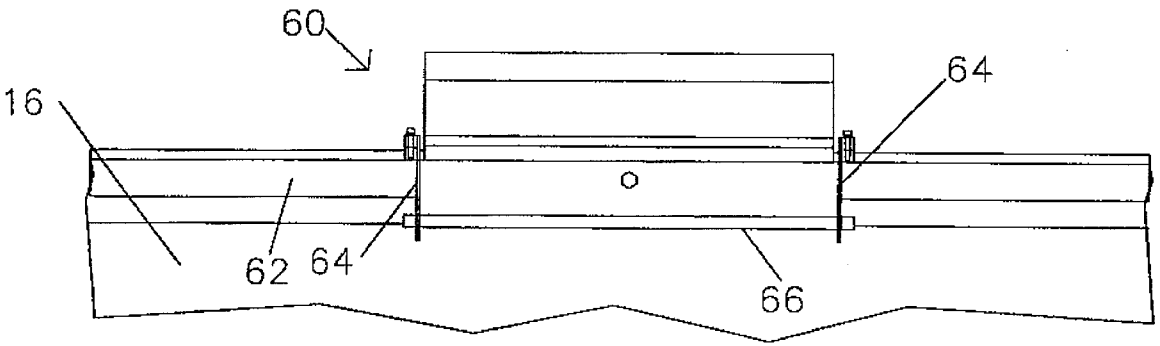
Figure 7A:
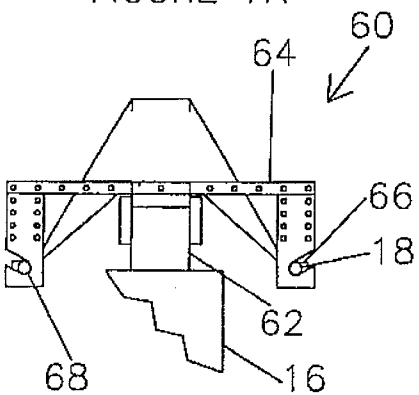

FIGS. 7 A–C show a forth embodiment of the markless system 60 which also advances the protective material 18 transversely across the punch 12 and die 14 of the press brake 16. In this embodiment, however, instead of having freestanding enclosures, the system 60 mounts directly on the lower tool holder 62 of the press brake. The mounting bracket 64 of the system bolts onto the lower tool holder 62 of the press brake. A roll of protective material 18 slightly wider than the width of the punch 12 and die 14 being used on the press brake is received on the first feed/take up reel 66 which is held by the mounting bracket 64. The protective material 18 passes up and over the die 14 of the press brake to the second feed/take up reel 68. This embodiment of the system may be motorized and automated like the previous embodiments described or it may be manually operated for simplicity and low cost.

Figure 8C:
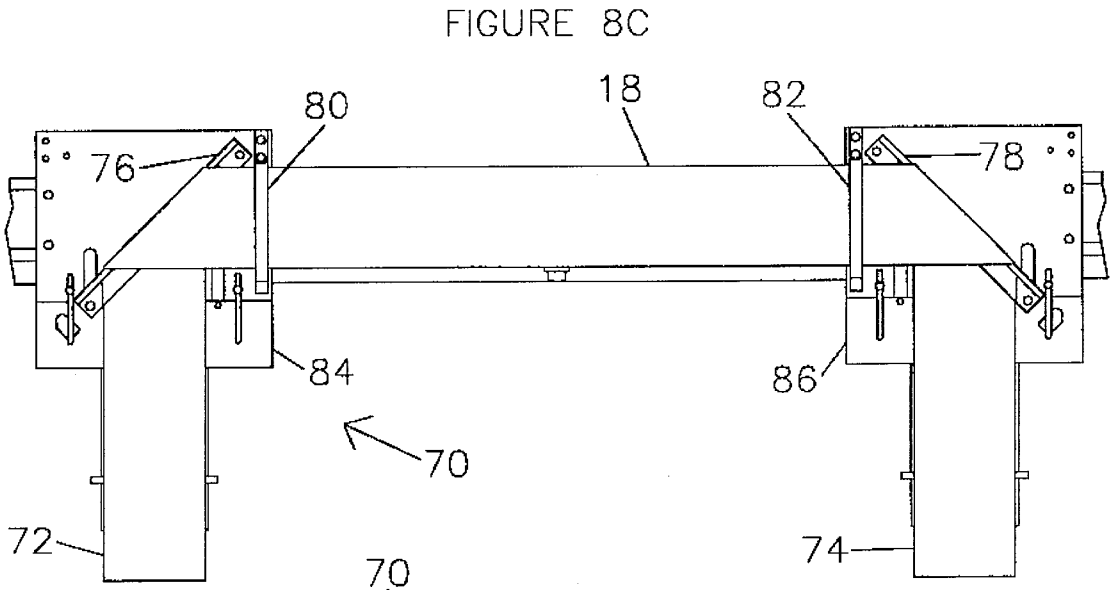
FIGS. 8 A–C show a fifth embodiment of the markless system which mounts on the tool holder of the press brake.
Figure 8B:
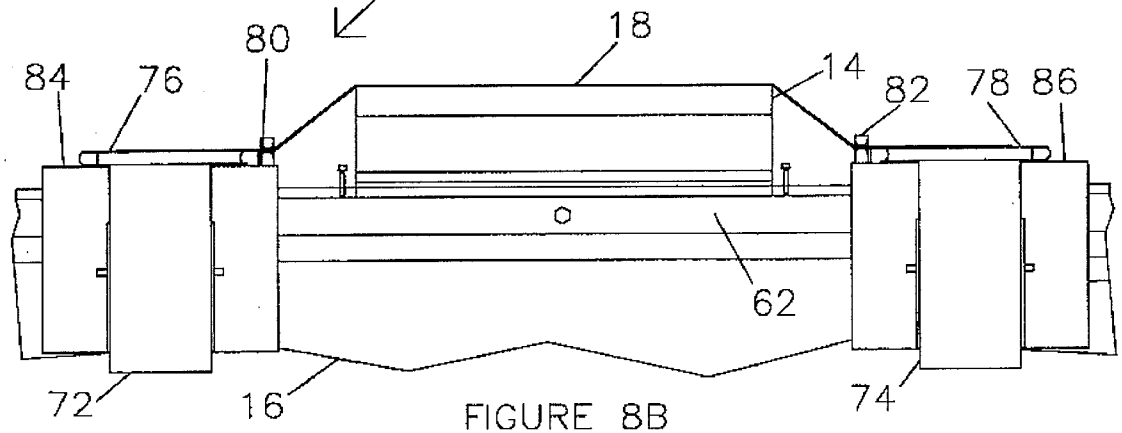
Figure 8A:
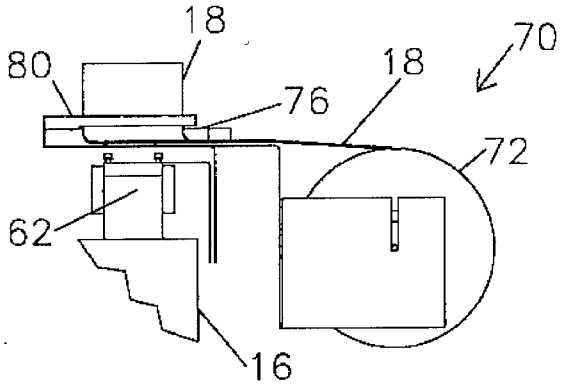

FIGS. 8 A–C show a fifth embodiment of the markless system 70 which also mounts on the lower tool holder 62 of the press brake. In this embodiment, the protective material 18 moves parallel to the punch 12 and die 14 of the press brake, but the feed/take up reels 72, 74 of the system 70 are mounted transversely. This is accomplished by having a pair of 45° guides 76, 78 which change the direction of the protective material web 18 from transverse to parallel to the punch 12 and die 14. A roll of protective material 18 is held by the first feed/take up reel 72. The protective material 18 passes from the first feed/take up reel 72 underneath and around the first 45° guide 76 so that it changes direction by 90°. The protective material 18 passes through another guide 80 which orients the web 18 so that it is horizontal coming off of the first 45° guide 76. This is necessary to equalize the path length traveled by both edges of the protective material web 18. From there, the protective material 18 passes up and over the die 14, then down to the next guide 82 which orients the web 18 horizontally before it passes over and around the second 45° guide 78. The protective material 18 changes its direction 90° as it passes around the second 45° guide 78, then it is wound onto the second feed/take up reel 74. One important advantage of this embodiment of the markless system is that it can be configured to cover any width of punch 12 and die 14 with only a narrow web of protective material 18. The width covered by the system is easily altered by moving the mounting plates 84, 86 of the system to any desired position along the lower tool holder 62 of the press brake. If multiple punches and dies are set up on the same press brake, the width of the system can be adjusted to cover one or all of the punch and die sets or multiple systems can be used to cover the punch and die sets individually. Once again, this system 70 can be either motor driven or manually operated.

Figure 9C:
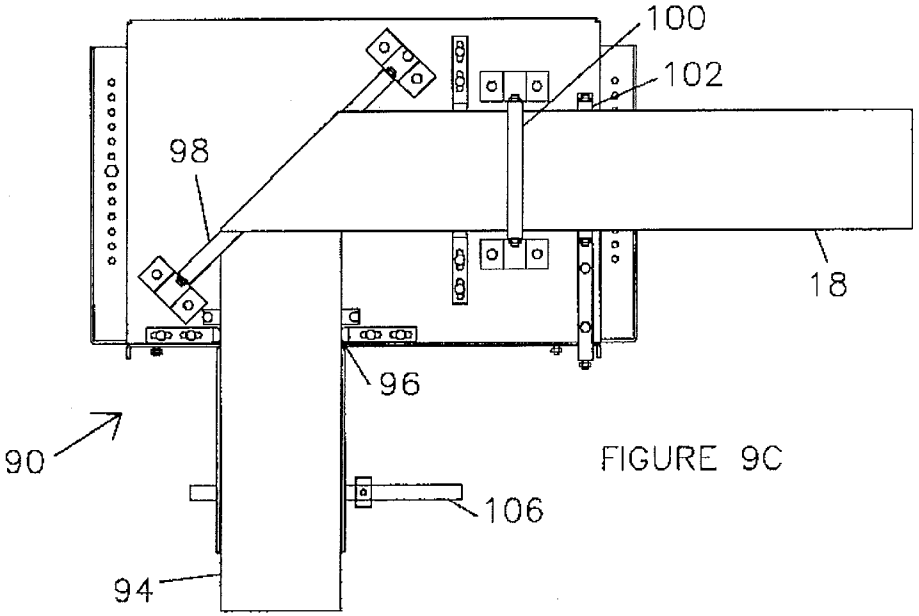
FIGS. 9 A–C show detail drawings of a crank-operated embodiment of the markless system.
Figure 9B:
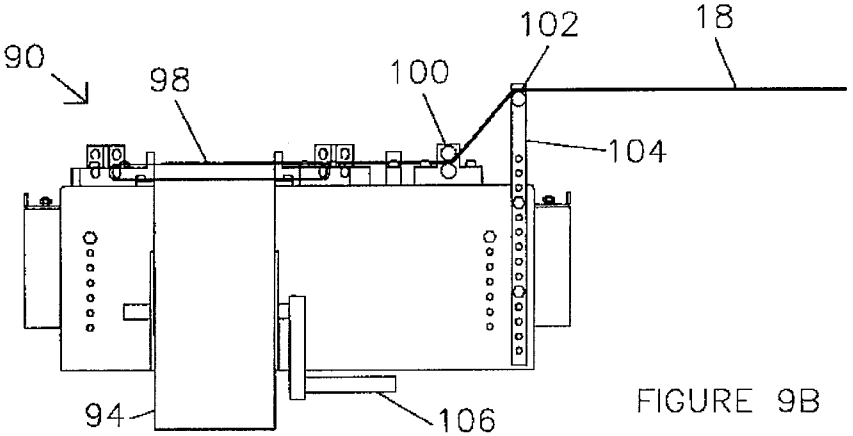
Figure 9A:
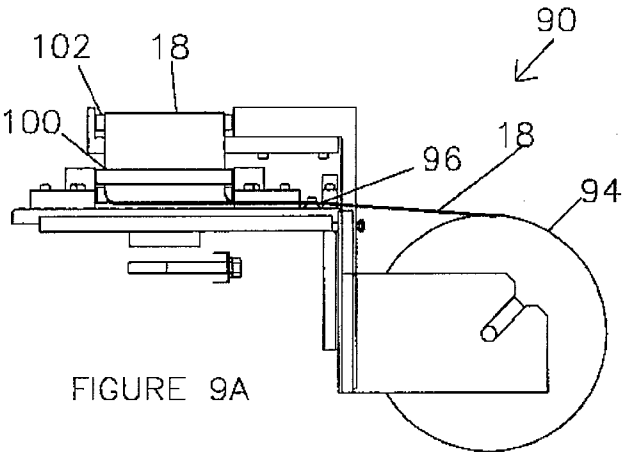

FIGS. 9 A–C show detail drawings of one side of a crank-operated embodiment of the markless system. The system also includes a second side which is a mirror image of what is shown in FIGS. 9 A–C. This system 90 is somewhat of a refinement of the embodiment shown in FIGS. 8 A–C. The system 90 mounts on the lower tool holder 62 of the press brake by an adjustable mounting plate 92. A roll of protective material 18 is held by the feed/take up reel 94. The protective material 18 passes from the feed/take up reel 94 under a first guide roller 96 which aligns it to the 45° guide roller 98. The protective material 18 passes underneath and around the 45° guide roller 98 so that it changes direction by 90°. The protective material 18 then passes through a third guide roller 100 which orients the web 18 so that it is horizontal coming off of the 45° guide roller 98 to equalize the path length. From there, the protective material 18 passes up and over a forth guide roller 102 with height adjustment 104 before it crosses the die 14. The feed/take up reel 94 is shown with a hand-operated crank 106 for manual operation of the system to illustrate one alternative to the motorized operation of the previously described embodiments.

Although the foregoing examples include many specificities, they are intended as illustrative of only some of the possible embodiments of the present invention. Other embodiments and modifications will, no doubt, occur to those skilled in the art. For example, the present invention could easily be modified to be used with other types of sheet metal forming equipment, such as a deep drawing press. Likewise, the system could be modified to utilize protective material in forms other than in roll form, such as protective material supplied in zigzag form. Thus, the examples given should only be interpreted as illustrations of some of the preferred embodiments of the invention, and the full scope of the invention should be determined by the appended claims and their legal equivalents.

I claim:

1. In combination:

a piece of sheet metal forming equipment having a punch and a die for forming a piece of sheet metal, a sheet of protective material having a first end and a second end, a first means for holding said first end of said sheet of protective material and a second means for holding said second end of said sheet of protective material with said sheet of protective material interposed between said piece of sheet metal and at least one of said punch or said die.

2. In combination:

a piece of sheet metal forming equipment having a punch and a die, a sheet of protective material, means for holding said sheet of protective material interposed between said punch and said die, and means for incrementally advancing said sheet of protective material with respect to said at least one of said punch or said die.

3. The combination of claim 2 wherein said piece of sheet metal forming equipment comprises a press brake.

4. The combination of claim 2 wherein said sheet of protective material comprises a material selected from the group of materials consisting of canvas, sailcloth, paper, plastic film, polyethylene film, polypropylene film, nylon film, polyurethane film, p.v.c. film, Tyvek®, and Kevlar®.

5. The combination of claim 2 wherein said means for holding said sheet of protective material interposed between said punch and said die comprises a first reel for receiving a first end of said sheet of protective material and a second reel for receiving a second end of said sheet of protective material, said first reel and said second reel being configured to hold said sheet of protective material interposed between said punch and said die.

6. The combination of claim 5 further comprising a motor drive means for turning at least one of said first reel or said second reel to incrementally advance said sheet of protective material with respect to said at least one of said punch or said die.

7. The combination of claim 5 wherein said punch and said die define an axis parallel to a width dimension of said piece of sheet metal forming equipment and wherein said first reel has a first axis of rotation and said second reel has a second axis of rotation, said first axis and said second axis being aligned parallel to the axis of said punch and said die.

8. The combination of claim 5 wherein said punch and said die define an axis parallel to a width dimension of said piece of sheet metal forming equipment and wherein said first reel has a first axis of rotation and said second reel has a second axis of rotation, said first axis and said second axis being aligned perpendicular to the axis of said punch and said die.

9. The combination of claim 5 wherein said punch and said die define an axis parallel to a width dimension of said piece of sheet metal forming equipment and wherein said first reel has a first axis of rotation and said second reel has a second axis of rotation, said first axis and said second axis being aligned perpendicular to the axis of said punch and said die, said means for incrementally advancing said sheet of protective material advancing said sheet of protective material in a direction parallel to the axis of said punch and said die.

10. In combination:

a press brake having a punch and a die, a sheet of protective material having a first end and a second end, a first reel for receiving said first end of said sheet of protective material and a second reel for receiving said second end of said sheet of protective material, means for holding said sheet of protective material interposed between said punch and said die, and means for incrementally advancing said sheet of protective material with respect to at least one of said punch or said die.

11. The combination of claim 10 wherein said punch and said die define an axis parallel to a width dimension of said piece of sheet metal forming equipment and wherein said first reel has a first axis of rotation and said second reel has a second axis of rotation, said first axis and said second axis being aligned parallel to the axis of said punch and said die, said means for incrementally advancing said sheet of protective material advancing said sheet of protective material in a direction perpendicular to the axis of said punch and said die.

12. The combination of claim 10 wherein said punch and said die define an axis parallel to a width dimension of said piece of sheet metal forming equipment and wherein said first reel has a first axis of rotation and said second reel has a second axis of rotation, said first axis and said second axis being aligned parallel to the axis of said punch and said die, said means for incrementally advancing said sheet of protective material advancing said sheet of protective material in a direction parallel to the axis of said punch and said die.

13. The combination of claim 12 wherein said means for holding said sheet of protective material interposed between said punch and said die comprises a first guide and a second guide, said first guide being mounted at an angle of 45° with respect to said first axis of rotation, said second guide being mounted at an angle of 45° with respect to said second axis of rotation, said protective material describing a path as follows: said sheet of protective material traveling from said first reel to said first guide in a path perpendicular to said first axis of rotation, said sheet of protective material passing around said first guide thereby changing direction to a path parallel to the axis of said punch and said die, said sheet of protective material traveling for a given distance in a direction parallel to the axis of said punch and said die, said sheet of protective material passing around said second guide thereby changing direction to a path perpendicular to the axis of said punch and said die, said sheet of protective material traveling from said second guide to said second reel in a path perpendicular to said second axis of rotation.

14. The combination of claim 13 further comprising a motor drive means for turning at least one of said first reel or said second reel to incrementally advance said sheet of protective material with respect to said at least one of said punch or said die.

15. The combination of claim 14 further comprising a programmable control means for controlling said motor drive means to incrementally advance said sheet of protective material with respect to said at least one of said punch or said die a given distance at a desired interval.

16. The combination of claim 10 wherein said press brake comprises at least one tool holder means for holding at least one of said punch or said die, and said combination further comprises at least one mounting means for mounting said first reel and said second reel to said tool holder means.

17. An apparatus for use with a piece of sheet metal forming equipment having a punch and a die for forming a piece of sheet metal, said apparatus comprising:

a sheet of protective material, means for holding said sheet of protective material interposed between said piece of sheet metal and at least one of said punch or said die, and means for incrementally advancing said sheet of protective material with respect to said at least one of said punch or said die.

18. The apparatus of claim 17 wherein said piece of sheet metal forming equipment comprises a press brake.

19. The apparatus of claim 18 wherein said press brake comprises at least one tool holder means for holding at least one of said punch or said die, and wherein said apparatus further comprises at least one mounting means for mounting said apparatus to said tool holder means.

20. The apparatus of claim 19 wherein said means for holding said sheet of protective material interposed between said piece of sheet metal and at least one of said punch or said die comprises a first reel mounted on said tool holder means for receiving a first end of said sheet of protective material and a second reel mounted on said tool holder means for receiving a second end of said sheet of protective material.

* * * * *